US008879961B2

(12) United States Patent
Igawa

(10) Patent No.: US 8,879,961 B2
(45) Date of Patent: Nov. 4, 2014

(54) IMAGE PROCESSING METHOD, IMAGE PROCESSOR, AND IMAGE FORMING APPARATUS USING SAME

(71) Applicant: Hiroyuki Igawa, Kanagawa (JP)

(72) Inventor: Hiroyuki Igawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 77 days.

(21) Appl. No.: 13/628,362

(22) Filed: Sep. 27, 2012

(65) Prior Publication Data

US 2013/0108326 A1 May 2, 2013

(30) Foreign Application Priority Data

Oct. 26, 2011 (JP) ..... 2011-235363

(51) Int. Cl.
*G03G 15/01* (2006.01)
*G03G 15/00* (2006.01)

(52) U.S. Cl.
CPC ..... *G03G 15/0189* (2013.01); *G03G 15/5058* (2013.01)
USPC ..... 399/231; 399/72

(58) Field of Classification Search
USPC ..... 399/49, 72, 231
See application file for complete search history.

(56) References Cited

U.S. PATENT DOCUMENTS 6,013,403 A * 1/2000 Ichikawa ..... 430/97
2012/0120454 A1 5/2012 Igawa

FOREIGN PATENT DOCUMENTS

| | | |
|---|---|---|
| JP | 9-326927 | 12/1997 |
| JP | 2000-305339 | 11/2000 |
| JP | 2005-17624 | 1/2005 |
| JP | 2005-284132 | 10/2005 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

An image processing method for generating a halftone pattern for forming an image according to input image data includes a step of forming first and second shade patterns to be developed by first and second toners, respectively. The second toner is identical in color to the first toner and different in shade from the first toner, and the second shade pattern is shifted from the first shade pattern.

12 Claims, 9 Drawing Sheets

IMAGE PROCESSING METHOD, IMAGE PROCESSOR, AND IMAGE FORMING APPARATUS USING SAME

CROSS-REFERENCE TO RELATED APPLICATION

This patent application is based on and claims priority pursuant to 35 U.S.C. §119 to Japanese Patent Application No. 2011-235363, filed on Oct. 26, 2011, in the Japan Patent Office, the entire disclosure of which is hereby incorporated by reference herein.

FIELD OF THE INVENTION

The present invention generally relates to an image forming apparatus such as a copier, a printer, a facsimile machine, a plotter, or a multifunction machine having at least two of these capabilities, and an image processing method and an image processor used in an image forming apparatus.

BACKGROUND OF THE INVENTION

Electrophotographic image forming apparatuses, such as copiers, printers, facsimile machines, plotters, or multifunction machines including at least two of these capabilities develop electrostatic latent images with toner.

For such image forming apparatuses, various methods of forming toner patterns are proposed aimed at, for example, image quality improvement. Further, JP-2000-305339-A proposes use of multiple identical color toners different in shade depending on the density of images to be output.

In electrophotographic image forming apparatuses, it is possible that toner scatters in other areas (i.e., background) than the positions to be developed with toner, thus reducing color stability, which is a phenomenon generally called scattering of toner or toner scattering. Scattering of toner can degrade image quality.

To alleviate adverse effects caused by toner scattering, image forming conditions may be changed in response to the degree of occurrence of toner scattering. However, changing image forming conditions in response to the degree of occurrence of toner scattering may degrade color stability. Therefore, it is preferable that adverse effects caused by scattering of toner are reduced using image processing. Additionally, simply using multiple identical color toners different in shade depending on the density of images may be insufficient to reduce adverse effects on image quality caused by scattering of toner.

BRIEF SUMMARY OF THE INVENTION

In view of the foregoing, one embodiment of the present invention provides an image processing method for generating a halftone pattern for forming an image according to input image data. The image processing method includes a step of forming first and second shade patterns for first and second toners, respectively. The second toner is identical in color to the first toner and different in shade from the first toner, and the second shade pattern is shifted from the first shade pattern.

Another embodiment provides an image processor for generating the halftone pattern using the above-described method.

Yet another embodiment provides an image forming apparatus that includes an image forming device to form a toner image according to input image data using first and second toners identical in color and different in shade from each toner, and the above-described image processor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
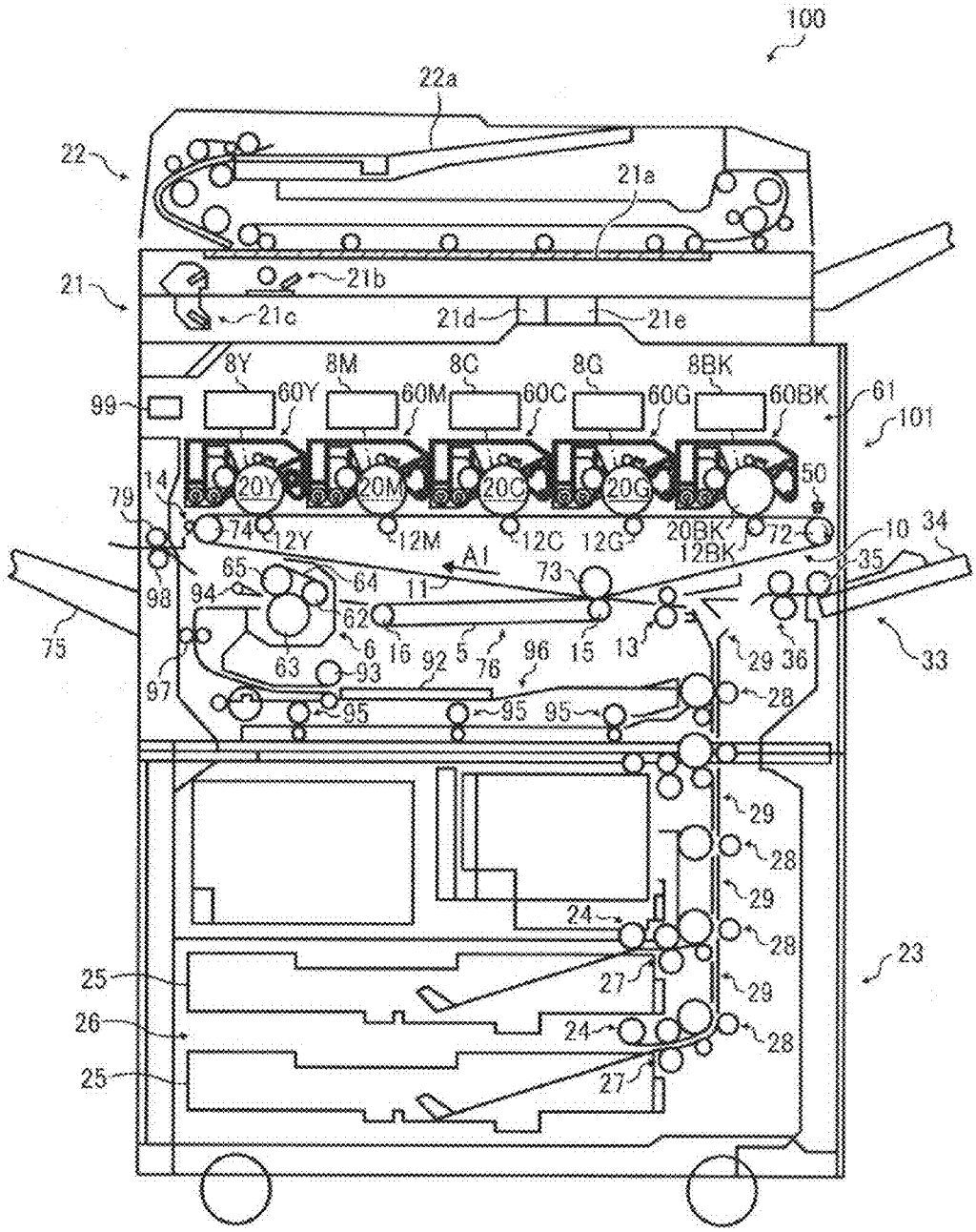
FIG. 1 is a front view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic vertical sectional view of an image forming apparatus 100.

The image forming apparatus 100 can be a multifunction digital machine capable of multicolor image formation, copying, printing, and facsimile transmission. Alternatively, the image forming apparatus according to the present embodiment may be a single color image forming apparatus; a single function machine capable of copying, printing, or facsimile transmission; or a multifunction machine having two of the above-described capabilities. When the image forming apparatus 100 is used as a printer, it performs image forming operation according to image signals converted from image data sent from an external device (e.g., a client computer). The image forming apparatus 100 performs image forming operation similarly when it is used as a facsimile machine.

The image forming apparatus 100 forms toner images on sheet type recording media such as plain paper generally used for copying, overhead projector (OHP) transparencies, thick paper (e.g., cards and postcards), and envelopes. Additionally, the image forming apparatus 100 can form toner images on both sides, that is, front and back sides, of a sheet serving as a recording medium.

Referring to FIG. 1, a structure of the image forming apparatus 100 is described below. The image forming apparatus 100 includes a body 101 (i.e., a printer unit) disposed in a center portion thereof in a vertical direction; a reader (e.g., a scanner) disposed above the body 101 to read images on originals (original documents); an automatic document feeder (ADF) 22 disposed above the reader 21 to load originals to be fed to the reader 21; and a sheet feeder 23 disposed beneath the body 101 to feed sheets of recording media to the body 101. The sheet feeder 23 serves as a sheet feeding table and feeds sheets to a position between an intermediate transfer belt 11 and the photoreceptor drums 20Y, 20M, 20C, 20G, and 20BK.

The image forming apparatus 100 is a tandem image forming apparatus employing a tandem image forming device 61, which incorporates photoreceptor drums 20Y, 20M, 20C, 20G and 20BK serving as image bearers that carry yellow, magenta, cyan, gray (light black), and black toner images, respectively. The photoreceptor drums 20Y, 20M, 20C, 20G, and 20BK having an identical diameter are aligned in a horizontal direction at identical intervals, facing an outer circumferential surface of the intermediate transfer belt 11 disposed in a vertical center portion of the body 101. The intermediate transfer belt 11 can be an endless belt and serves as an intermediate transfer member that carries different color toner images transferred from the respective photoreceptor drums 20.

The intermediate transfer belt 11 is rotatable clockwise in FIG. 1 as indicated by arrow A1 (hereinafter "direction A1") with its outer circumferential surface facing the photoreceptor drums 20Y, 20M, 20C, 20G and 20BK. The toner images, that is, visualized images, formed on the photoreceptor drums 20Y, 20M, 20C, 20G and 20BK are primarily transferred therefrom and superimposed one on another on the intermediate transfer belt 11, thus forming a multicolor image. Then, the multicolor image is secondarily transferred onto a surface of the sheet at a time. Thus, the image forming apparatus 100 employs an intermediate transfer method or an indirect transfer method in which different color toner images formed on the respective photoreceptor drums 20 are transferred onto the sheet indirectly via the intermediate transfer belt 11. Thus, the image forming apparatus 100 is a tandem electrophotographic image forming apparatus employing an indirect transfer method.

Primary-transfer rollers 12Y, 12M, 12C, 12G, and 12BK serving as transfer chargers are disposed on an inner circumferential surface of the intermediate transfer belt 11, facing the respective photoreceptor drums 20 via the intermediate transfer belt 11. The primary-transfer rollers 12 apply transfer bias voltages to the intermediate transfer belt 11. Thus, primary image transfer is performed sequentially in the direction A1 at primary-transfer positions immediately under the respective photoreceptor drums 20 to superimpose the toner images transferred from the respective photoreceptor drums 20 one on another at an identical or similar position of the intermediate transfer belt 11 as the intermediate transfer belt 11 rotates.

The photoreceptor drums 20Y, 20M, 20C, 20G, and 20BK are arranged in this order in the direction A1 from the left to the right in FIG. 1. The photoreceptor drums 20Y, 20M, 20C, 20G, and 20BK are respectively incorporated in image forming stations 60Y, 60M, 60C, 606G, and 60BK that form yellow, magenta, cyan, gray (light black) and black toner images.

In the image forming apparatus 100, black toner images are formed by superimposing a light black toner image formed on the photoreceptor drum 20G and a darker black toner image formed on the photoreceptor drum 20BK. Light black is hereinafter referred to as "gray".

The image forming apparatus 100 includes the image forming stations 60Y, 60M, 60C, 60G, and 60BK, together forming the tandem image forming device 61, an intermediate transfer belt unit 10 incorporating the intermediate transfer belt 11, disposed beneath the tandem image forming device 61, and a secondary-transfer unit 76 disposed across the intermediate transfer belt unit 10 from the tandem image forming device 61 and facing the intermediate transfer belt 11. The secondary-transfer unit 76 includes an endless secondary-transfer belt 5 disposed in contact with the intermediate transfer belt 11 to form a secondary-transfer nip therebetween and transfers the multicolor toner image formed on the intermediate transfer belt 11 onto a sheet while transporting the sheet. At a contact position therebetween, the secondary-transfer belt 5 and the intermediate transfer belt 11 rotate in an identical direction.

The image forming apparatus 100 further includes optical writing devices 8 disposed above and facing the respective image forming stations 60, a pair of registration rollers 13, and a sheet detector to detect arrival of a leading end of the sheet at the registration rollers 13. The registration rollers 13 stop the sheet fed from the sheet feeder 23 and then forward the sheet to a secondary-transfer position between the intermediate transfer belt 11 and the secondary-transfer belt 5, timed to coincide with image formation in the respective image stations 60.

Additionally, a fixing device 6 (e.g., a fuser unit) and an output unit 79 are provided downstream from the secondary-transfer unit 76 in that order in the sheet conveyance direction, and a duplex unit 96 is provided beneath the secondary-transfer unit 76 and the fixing device 6 and in parallel to the tandem image forming device 61. The fixing device 6 fixes the toner image on the sheet conveyed from the secondary-transfer unit 76. The output unit 79 incorporates an output path through which the sheet bearing the fixed toner image is discharged outside the image forming apparatus 100 and a reverse path through which the sheet bearing the fixed toner image is conveyed to the registration rollers 13. For example, when a user selects duplex printing, after an image is fixed on the front side thereof, the sheet is conveyed through the reverse path of the output unit 79 to the duplex unit 96. The duplex unit 96 switchbacks and reverses the sheet to the registration rollers 13, and the registration rollers 13 feed the sheet to the secondary-transfer nip where another toner image is transferred onto the back side of the sheet.

By contrast, when the user does not select the duplex printing, the sheet discharged from the fixing device 6 is discharged onto an output tray 75 attached to one side of the body 101. A bypass tray unit 33 is attached to another side of the body 101 to load recording media such as paper sheets, OHP transparencies, cards, and envelopes. The image forming apparatus 100 further includes a control panel disposed atop the body 101 with which the user inputs instructions, a controller 99 disposed inside the body 101 to control overall operations of the image forming apparatus 100, and a waste toner tank.

Figure 2:
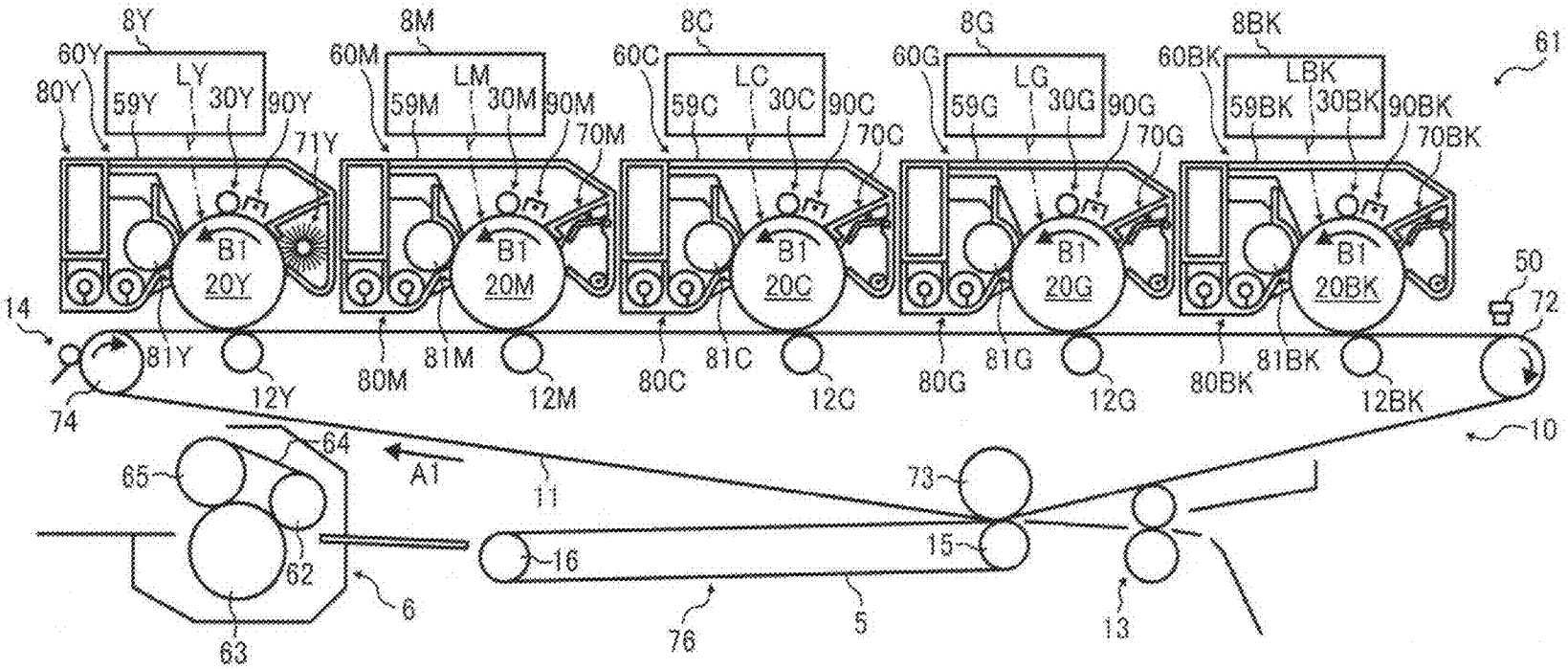
FIG. 2 is a front view of a configuration usable for the image forming apparatus shown in FIG. 1, in which multiple development devices using identical color toners different in shade are provided.

As shown in FIG. 2, the intermediate transfer belt unit 10 further includes a belt cleaning unit 14 and first through third support rollers around which the intermediate transfer belt 11 is looped, namely, a tension roller 72 serving as a driving roller to rotate the intermediate transfer belt 11, a transfer entrance roller 73, and a tension roller 74. The belt cleaning unit 14 presses against the tension roller 74 via the intermediate transfer belt 11 and cleans the surface of the intermediate transfer belt 11.

The intermediate transfer belt unit 10 further includes an optical detector 50 disposed facing the intermediate transfer belt 11 at a position downstream from the tandem image forming device 61 and upstream from the secondary-transfer unit 76 in the direction A1, a driving motor to drive the driving roller 72, thereby rotating the intermediate transfer belt 11 in the direction A1, a belt shifting unit. In the present embodiment, the optical detector 50 is a reflection-type optical sensor to detect toner images on the intermediate transfer belt 11 optically. The belt shifting unit moves the intermediate transfer belt 11 and the like depending on the type of image formation, monochrome image formation using black toner or multicolor image formation using at least two different color toners. It is to be noted that, alternatively, the transfer entrance roller 73 or the tension roller 74 may be configured to serve as the driving roller instead of the tension roller 72, and other rollers serve as driven rollers.

Although fluororesin, polycarbonate resin, polyimide resin are conventionally used for intermediate transfer belts, a recent trend is use of elastic belts in which all or some of the layers of the belt is constructed of an elastic material.

In multicolor image formation, the belt shifting unit keeps the intermediate transfer belt 11 at the position shown in FIG. 1 so that a substantially horizontal upper portion of the intermediate transfer belt 11, which is kept taut, contacts the respective photoreceptor drums 20. In monochrome image formation, the belt shifting unit lowers the intermediate transfer belt 11 on the left in FIG. 1, thereby disengaging the intermediate transfer belt 11 from the photoreceptor drums 20Y, 20M, and 20C, and thus the intermediate transfer belt 11 contacts only the photoreceptor drums 20G and 20BK. In monochrome image formation, in addition to rotation of the photoreceptor drums 20, actions of components of the image forming stations 60Y, 60M, and 60C are stopped. In such a configuration, it is preferable that the five image forming stations 60 are arranged in the order of cyan, magenta, yellow, gray, and black in the direction A1 above the upper portion of the intermediate transfer belt 11 stretched between the tension rollers 72 and 74. It is to be noted that the order of colors in multicolor image formation depends on features, advantages, or specifications of the image forming apparatus.

The belt cleaning unit 14 includes a fur brush serving as a cleaning member disposed in contact with the intermediate transfer belt 11, a blade in contact with the bur brush, and a mechanism to engage and disengage the fur brush from the intermediate transfer belt 11. The fur brush is disposed to rotate in the counter direction to the rotation of the intermediate transfer belt 11 by contact with the intermediate transfer belt 11. The belt cleaning unit 14 cleans the surface of the intermediate transfer belt 11 using the fur brush as the intermediate transfer belt 11 rotates in the direction A1. Further, the blade removes toner, which has been transferred from the intermediate transfer belt 11 to the fur brush, from the fur brush.

The optical detector 50 reads reflection properties of an image patch pattern that is a reference toner image for toner density adjustment in a so-called process control performed separately from image forming operation instituted by users.

As shown in FIG. 1, in addition to the secondary-transfer belt 5, the secondary-transfer unit 76 includes a driving roller 15 and a driven roller 16 over which the secondary-transfer belt 5 is stretched, the transfer entrance roller 73 serving as a backup roller facing the secondary-transfer belt 5 via the intermediate transfer belt 11, and a power supply that applies a secondary-transfer bias in a polarity opposite a polarity of toner to the driving roller 15.

Since the driving roller 15 and the transfer entrance roller 73 sandwich the secondary-transfer belt 5 and the intermediate transfer belt 11, the secondary-transfer nip is created between the secondary-transfer belt 5 and the intermediate transfer belt 11 contacting each other. As the power supply applies the secondary-transfer bias to the driving roller 15, a secondary-transfer electric field is created in the secondary-transfer nip, where the driving roller 15 electrostatically transfers the toner image, which is formed by superimposing a maximum of five color toners, from the intermediate transfer belt 11 to the sheet nipped and conveyed between the intermediate transfer belt 11 and the secondary-transfer belt 5. For example, the toner image is transferred by the secondary-transfer electric field and pressure exerted between the intermediate transfer belt 11 and the secondary-transfer belt 5 onto the sheet fed by the pair of registration rollers 13 and conveyed therebetween.

Although the secondary-transfer unit 76 in the present embodiment has a capability to transport the sheet from the intermediate transfer belt 11 to the transfer sheet, alternatively, the secondary-transfer unit 76 may employ a secondary-transfer roller or a contactless charger. However, this configuration requires a separate component to convey the sheet to the fixing device 6.

The fixing device 6 includes a heating roller 62 inside which a heat source is provided, a fixing roller 65, a fixing belt 64 stretched around the heating roller 62 and the fixing roller 65, and a pressure roller 63 pressed against the fixing roller 65 via the fixing belt 54, forming a fixing nip. The heating roller 62, the fixing belt 64, and the fixing roller 65 together form a belt unit in which the fixing belt 64 rotates. The fixing device 6 is designed to fix the toner image on the sheet with beat and pressure while transporting the sheet through the fixing nip.

Referring to FIG. 2, the optical writing devices 8 direct laser beams L according to image signals to the respective photoreceptor drums 20, thereby exposing the surfaces of the photoreceptor drums 20. Thus, electrostatic latent images are formed on the respective photoreceptor drums 20. Thus, the photoreceptor drums 20 also serve as latent image bearers.

An image processor implemented as a capability of the controller 99 generates the laser beams L according to image data captured by the reader 21, data obtained by facsimile transmission, or image data input from external input devices such as computers to form a latent image corresponding to halftone toner patterns for forming a color image corresponding to the image data.

In other words, the beams L are optical data converted from image signals corresponding to the halftone toner pattern for forming the respective color toners, and the optical writing devices 8 fix the optical data as the latent images on the respective photoreceptor drums 20. It is to be noted that other types of exposure units such as those employing a light-emitting diode (LED) may be used instead of the laser-type optical writing devices 8.

Referring to FIG. 1, the output unit 79 includes a pair of conveyance rollers 97 to convey the sheet bearing the fixed toner image discharged from the fixing device 6 to the duplex unit 96; a pair of output rollers 98 that discharges the sheet onto the output tray 75; and a switch pawl 94 that guides the sheet to the output path provided with the output rollers 98 or the reverse path provided with the conveyance rollers 97.

The duplex unit 96 includes a tray 92 that temporarily stores the sheet bearing the toner image on the front side thereof, conveyed from the output unit 79; a pair of reverse rollers 93 to switchback the sheet placed on the tray 92; and multiple pairs of feed rollers 95 to feed the sheet conveyed from the reverse rollers 93 to the registration rollers 13.

The sheet feeder 23 includes a paper bank 26 serving as a sheet feeder unit incorporating multiple paper trays 25 arranged vertically; pickup rollers 24; pairs of separation rollers 27; pairs of conveyance rollers 28; and a conveyance path 29. Each paper tray 25 can accommodate multiple sheets, and each pickup roller 24 contacts and picks up a sheet on the top on the paper tray 25. The separation rollers 27 separate the sheet picked up by the pickup roller 24 from other sheets and feeds the sheet to the conveyance rollers 28. The conveyance rollers 28 convey the sheet fed by the separation rollers 27 to the registration rollers 13 through the conveyance path 29.

Along the conveyance path 29, the sheet sent out by the pickup roller 24 and the separation rollers 27 is transported by pairs of conveyance rollers 28 to the registration rollers 13 positioned at a downstream end of the conveyance path 29. The conveyance path 29 extends from the sheet feeder 23 into the body 101, and the conveyance rollers 28 are also provided along the conveyance path 29 inside the body 101.

Specifically, as the pickup roller 24 rotates counterclockwise in FIG. 1 and the separation rollers 27 rotate, the sheets are fed from the top to the conveyance path 29. Then, the conveyance rollers 28 rotate and convey the sheet to the registration rollers 13. When a leading edge of the sheet strikes the registration rollers 13, skew of the sheet can be corrected.

The bypass tray unit 33 includes a bypass tray 34 for containing multiple sheets; a pickup roller 35 that contacts and picks up a sheet on the top on the bypass tray 34; a pair of separation rollers 36 that separates the top sheet picked up by the pickup roller 35 from other sheets; and a sensor that detects the presence of sheets on the bypass tray 34.

As the pickup roller 35 rotates clockwise in FIG. 1 and the pair of separation rollers 36 is rotated, the pair of separation rollers 36 guides the uppermost sheet to the conveyance path 29 situated inside the body 101 and connected to the pair of registration rollers 13. When a leading edge of the sheet strikes the pair of registration rollers 13, the pair of registration rollers 13 halts the sheet.

The reader 21 includes an exposure glass 21*a*, a first carriage 21*b* that moves from side to side in FIG. 1, a second carriage 21*c*, an imaging lens 21*d*, a reading sensor 21*e*, and the like. The first carriage 21*b* includes a light source that emits light to the original placed on the exposure glass 21*a*, and a first reflector that reflects the light reflected from a surface of the original. The second carriage 21*c* includes a second reflector that reflects the light reflected by the first reflector. The imaging lens 21*d* focuses the light reflected by the second reflector on the reading sensor 21*e*, and thus the reading sensor 21*e* reads image data of the original.

The ADF 22 includes a document table 22*a* on which originals are placed. The ADF 22 is pivotable with respect to the reader 21. When the user lifts the ADF 22, the exposure glass 21*a* of the reader 21 is exposed.

The control panel includes a liquid crystal (LC) display and a variety of keys such as a start button to start copying or the like and numeric keys to input, for example, the number of copies. On the control panel, the user can select either multicolor image formation or monochrome image formation; and either single-side (simplex) printing or double-side (duplex) printing. Regarding single-side printing, the user can select one of three different modes: a direct discharge mode, a reverse discharge mode, and a reverse decal discharge mode.

The controller 99 includes a central processing unit (CPU) and storage units such as a random-access memory (RAM) and a read-only memory (ROM).

Descriptions are given below of a structure of the image forming station 60BK for forming black toner images with reference to FIG. 2.

Since the other image forming stations 60Y, 60M, 60C, and 60G have an identical or similar structure to that of the image forming station 60BK, descriptions thereof are omitted. It is to be noted that the suffixes Y, M, and C attached to each reference numeral indicate that components indicated thereby are used for forming yellow, magenta, and cyan images, respectively, and suffixes G and BK indicate that components indicated thereby are used for forming black images.

As shown in FIG. 2, in the image forming station 60BK, the primary-transfer roller 12BK, a drum cleaning unit 70BK serving as a primary-transfer cleaning unit, a discharger 90BK, a charging device 30BK, and a development device 80BK are provided in that order in the direction of rotation of the photoreceptor drum 20BK indicated by arrow B1 (hereinafter "direction B1"). The components around the photoreceptor drum 20BK may be housed in a common unit casing, a cartridge case 59BK. The image forming station 60BK further includes a power source to apply a primary-transfer bias in the positive polarity to the primary-transfer roller 12. In the present embodiment, a normal charging polarity of toner is negative, and the polarity of the primary-transfer bias is opposite the polarity of the normal charging polarity of toner.

The photoreceptor drum 20BK, the drum cleaning unit 70BK, the charging device 30BK, and the development device 80BK are united by the cartridge case 59BK, thus forming a process cartridge (i.e., the image forming station 60BK). The image forming station 60BK configured as the process cartridge is pushed into and pulled out from the body 101 along a guide rail. Thus, the image forming station 60BK can be removably installed in the body 101 and replaceable.

When the user pushes the image forming station 60BK into the body 101, the image forming station 60BK slides on the guide rail to a predetermined position suitable for image formation, and the position is fixed. The multiple components packaged in the cartridge case 59BK can be replaced at a time, thereby facilitating maintenance work. Additionally, when the operational lives of the components housed in the cartridge case 59BK are the same or similar, unnecessary replacement can be prevented.

The photoreceptor drum 20BK and at least one of the drum cleaning unit 70BK, the discharger 90BK, the charging device 30BK, and the development device 80BK are packaged in the cartridge case 59, forming the process cartridge removably installed in the body 101. Additionally, the tandem image forming device 61 as a whole may be configured as a single process cartridge removably installed in the body 101 at a time.

The toner image formed on the photoreceptor drum 20BK is transferred in the primary-transfer nip formed by the primary-transfer roller 12BK pressing against the photoreceptor drum 20BK via the intermediate transfer belt 11, and the primary-transfer nip serves as a transfer position. The primary-transfer roller 12BK receives from the power source the primary-transfer bias under constant voltage control. It is to be noted that, instead of the primary-transfer rollers 12, electroconductive brushes or contactless corona chargers may be used as primary-transfer members.

The discharger 90BK includes a discharge lamp disposed adjacent to the surface of the photoreceptor drum 20BK for removing electricity from the surface of the photoreceptor drum 20BK, initializing the electrical potential thereon. The charging device 30 includes a charging roller disposed in contact with the surface of the photoreceptor drum 20BK and a cleaning roller disposed in contact with the charging roller. As the photoreceptor drum 20BK rotates, the charging roller rotates, and further the cleaning roller rotates.

The charging roller is connected to a voltage applicator that applies a superimposed bias composed of an alternating current (AC) component superimposed on a direct current (DC) component to the charging roller. After the discharger 90BK discharges the outer circumferential surface of the photoreceptor drum 20BK, the charging roller charges it uniformly to the predetermined polarity in a charging region where the charging roller faces the photoreceptor drum 20BK. The cleaning roller cleans the charging roller while rotating as the charging roller rotates.

As described above, the contact-type charging system is used in the present embodiment, rollers disposed adjacent to but not in contact with the photoreceptor drum 20BK or contactless scorotron chargers may be used instead.

The development device 80BK includes a development roller 81BK disposed adjacent to and facing the photoreceptor drum 20BK, a bias applicator to apply a DC component as a development bias to the development roller 81BK, a toner cartridge for containing toner, a toner concentration detector, and a toner supply unit. In the present embodiment, the development roller 81BK carries two-component developer including toner (toner particles) and carrier (carrier particles). For example, the toner concentration detector detects, as the concentration of toner, the percent by weight of toner relative to carrier in the developer contained in the development device 80BK. The toner supply unit supplies toner from the toner cartridge to the development device 80BK according to detection signals from the toner concentration detector to adjust the concentration of toner to a predetermined target value (i.e., a target concentration).

For example, two-component developer usable in the present embodiment includes magnetic carrier and color toner whose normal charging polarity is minus (negative). The development bias may be an AC component or superimposed bias including a DC component and an AC component superimposed thereon.

Although shade, that is, the concentration of black toner used therein is different between the development devices 80BK and 80G, the other configurations thereof are similar. Specifically, different types of toners identical in color but different in shade are used in the development devices 80BK and 80G. The amount of pigment is adjusted such that the toner contained in the development device 80BK develops heavier color than that developed by the toner contained in the development device 80G.

Accordingly, lightness or color strength of toner images developed by the toner contained in the development device 80BK and the toner contained in the development device 80G are different from each other. It is to be noted that toner used in the development device 80BK has a color strength for standard black, and toner used in the development device 80G is adjusted to have a lower color strength. That is, the amount of pigment is adjusted to achieve such relative color strengths.

Between the charging device 30BK and the development device 80BK, the surface of the photoreceptor drum 20BK is exposed by the beam LBK emitted from the optical writing device 8BK after being charged by the charging device 30BK. Then, an electrostatic latent image is formed thereon according to image data.

The drum cleaning unit 70BK includes a cleaning blade and a waste toner conveyance member. An end of the cleaning blade contacts the surface of the photoreceptor drum 20BK to remove toner, carrier, and paper dust remaining thereon (hereinafter collectively "waste toner") after image transfer. The waste toner is then conveyed by the waste toner conveyance member to the waste toner tank. The drum cleaning unit 70BK may include a fur brush roller instead of or in addition to the cleaning blade. Alternatively, a magnetic brush cleaning method may be used.

In the image forming station 60BK described above, as the photoreceptor drum 20BK rotates in the direction B1, the charging roller uniformly charges the photoreceptor drum 20BK The optical writing device 8BK forms an electrostatic latent image for black image by potential decay. The development device 80BK develops the electrostatic latent image with black toner, which is transferred by the primary-transfer roller 12BK onto the intermediate transfer belt 11 rotating in the direction A1 due to the primary-transfer electrical field and nip pressure. The cleaning unit 70BK removes a foreign substance containing residual toner, and the discharger discharges the surface of the photoreceptor drum 20Y, which is then charged by the charging roller for subsequent image formation.

Referring to FIGS. 1 and 2, the following describes copying operation of the image forming apparatus 100.

The user sets an original on the document table 22*a* of the ADF 22; or lifts the ADF 22, places the original on the exposure glass 21*a*, and holds it with the ADF 22. Then, the use presses the start button on the control panel. A bundle of originals that is not bound together can be placed on the ADF 22. In a case of a bundle of originals bound like a book on one side, the bundle is placed on the exposure glass 21*a*. Alternatively, when the image forming apparatus 100 is used as a printer, the user selects image data for an image to be printed by using an external device, such as a client computer, connected to the image forming apparatus 100, and then selects a print button on a computer screen.

When the original is set on the document table 22*a* of the ADF 22, the ADF 22 feeds the original onto the exposure glass 21*a*, and then the reader 21 reads an image on the original. When the original is placed on the exposure glass 21*a*, the reader 21 reads the image on the original after the user presses the start button on the control panel. Thus, the reader 21 generates image data.

According to the image data, the controller 99 functions as an image processor and generates yellow, magenta, and cyan halftone toner patterns according to a processing method described later. Simultaneously, a halftone toner pattern for black image is generated as a synthesized image pattern constructed of a lighter color pattern developed by the toner contained in the development device 80G and a heavier color pattern developed by the toner contained in the development device 80BK. Using these patterns, yellow, magenta, cyan, and black images are formed in the respective image forming stations 60 so that they can be superimposed one on another on the intermediate transfer belt 11.

In parallel to the image reading operation, the components of the image forming stations 60, the intermediate transfer belt unit 10, the secondary-transfer unit 76, and the fixing device 6 start driving. As the intermediate transfer belt 11 rotates in the direction A1, the superimposed image on the intermediate transfer belt 11, constructed of yellow, magenta, cyan, and black toners, is transported to the secondary-transfer nip and secondarily transferred onto the sheet. Thus, a full-color image is formed on the sheet.

For example, the sheet is fed by one of the feed rollers 24 selected according to the sheet size and orientation contained in the image data. The feed roller 24 feeds the uppermost sheet from the paper tray 25 installed in the paper bank 26 toward the pair of registration rollers 13 while the pair of separation rollers 28 separates the uppermost sheet from other sheets loaded in the paper tray 25. Alternatively, the sheet is fed from the bypass tray 34 installed in the bypass tray unit 33 by the pickup roller 35 while the pair of separation rollers 36 separates the sheet from other sheets loaded on the bypass tray 34. Yet alternatively, the sheet is fed by the pair of feed rollers 95 of the duplex unit 96. In either case, the sheet is conveyed through the conveyance path 29 to the pair of registration rollers 13 and halted temporarily by the pair of registration rollers 13 when it strikes the pair of registration rollers 13.

The pair of registration rollers 13 resumes sheet conveyance in response to detection signals generated by a sensor when a leading end of the color toner image on the intermediate transfer belt 11 faces the secondary-transfer belt 5. Thus, the pair of registration rollers 13 feeds the sheet to the secondary-transfer nip at the time when the color toner image formed on the intermediate transfer belt 11 is secondarily transferred onto the sheet. Sheet feeding can be started at substantially simultaneously with the image reading operation.

The sheet bearing the multicolor toner image is conveyed to the fixing device 6. As the sheet is conveyed through the fixing nip formed between the fixing belt 64 and the pressing roller 63, the toner image is fixed on the sheet with heat and pressure. Then, the sheet is guided by the switch pawl 94 either toward the output tray 75 through the output roller pair 98 that discharges the sheet onto the output tray 75 or toward the duplex unit 96 through the conveyance roller pair 97 for duplex printing.

For satisfactory image formation, it is preferred that the density of toner images formed in the respective image forming stations 60, that is, image density, be kept constant. Therefore, in the image forming apparatus 100, separately from standard image formation instructed by users, process control operation, more particularly, image density adjustment, is performed at a timing of power-on or after images are formed on a predetermined number of sheets. For example, image density adjustment is performed to adjust the amount of toner adhering to the photoreceptor drums 20 (hereinafter "amount of adhering toner").

The process control (image density adjustment) in the image forming apparatus 100 is described below.

In the respective image forming stations 60Y, 60C, 60M, 60G, and 60BK, the image patch patterns are formed on the respective photoreceptor drums 20. Then, the image patch patterns are transferred onto separate regions of the intermediate transfer belt 11 and read optically by the optical detector 50. The controller 99 adjusts the output of the voltage applicators for the charging devices 30, output of the bias applicators for the development devices 80, and driving of the toner supply units to adjust the density of the image patch patterns to preferable values.

Specifically, the voltage output in accordance with the density of the image patch pattern read by the optical detector 50 is input to the controller 99. The controller 99 converts the output voltage into the amount of adhering toner according to a conversion algorithm using a conversion method for the amount of adhering powder. The controller 99 then calculates a development γ and a development start voltage Vk that indicate the developability at that time. Based on the calculated values, the controller 99 adjusts the output of the voltage applicators for the charging devices 30 to adjust the charging biases and output of the bias applicators for the development devices 80 to adjust the development biases, and changes the target values in detection by the toner concentration detectors in the respective development devices 80.

In electrophotographic image forming apparatuses that develop electrostatic latent images with toner, typically it is possible that toner scatters in areas other than the intended positions. Such scattering of toner can reduce color stability, thereby degrading image quality. The term "toner scattering" means a phenomenon in which toner adheres to areas of the photoreceptor drum 20 other than the electrostatic latent image, a phenomenon in which toner adheres to the background of images on the sheet in image transfer, and a phenomenon in which toner adheres to areas of the intermediate transfer member other than the intended image positions in primary image transfer.

Degradation of color stability resulting from scattering of toner is described below. Initially, the relation between mean brightness indicating image brightness level and mean background brightness indicating the brightness level of backgrounds of images is described.

Brightness (brightness level) used in this specification means an index within a range from 0 to 255 for representing brightness of a single pixel. When the brightness is close to zero, the image or the background is dark, and the color is close to black. When the brightness is close to 255, the image or the background is bright, and the color is close to white. The term "mean brightness" typically means the mean brightness of images and equals to the mean value of brightness of all pixels in an image (hereinafter "mean image brightness"). The term "mean background brightness" used in this specification means the mean value of all pixels in the background of the image.

Figure 3:
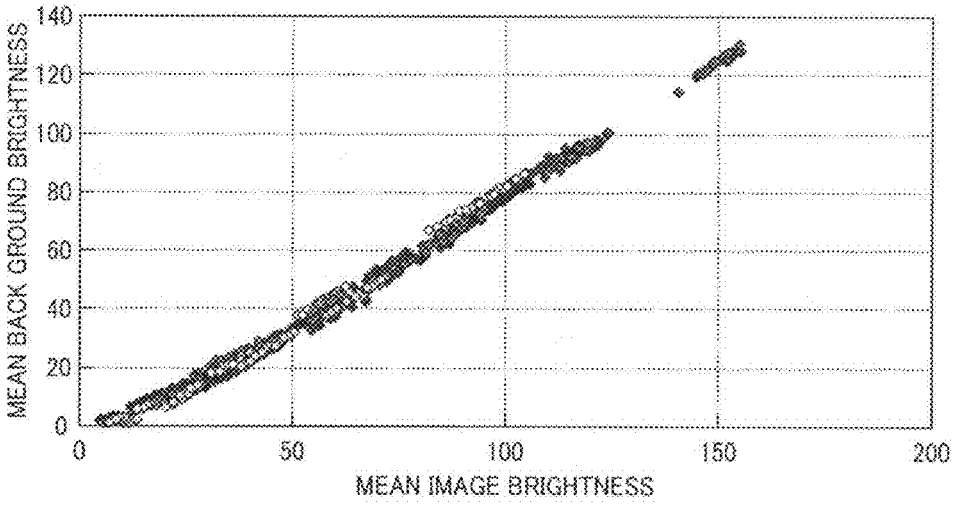
FIG. 3 is a graph illustrating the relation between mean image brightness and mean background brightness.

FIG. 3 illustrates the relations between the mean image brightness and the mean background brightness. As can be known from FIG. 3, image brightness is highly correlated with background brightness. In other words, degradation of stability of background brightness can degrade stability of image brightness. Accordingly, if the background brightness is changed by toner scattering, it can be assumed that toner scattering degrades the stability of image brightness.

Next, the relation between occurrence of toner scattering and color stability is described below. To develop images having high image area ratios, the amount of adhering toner increases, thus increasing the possibility of concurrence of toner scattering.

Figure 4:
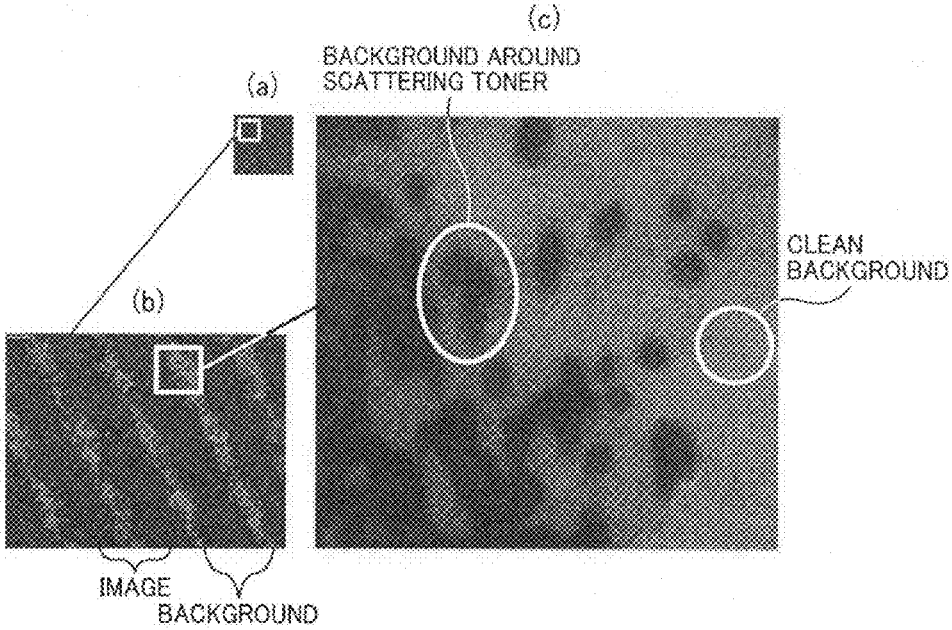
FIG. 4 is a diagram illustrating the occurrence and effects of toner scattering, in which (b) illustrates an image of (a) partly in a larger scale, and (c) illustrates an image of (b) in a larger scale.

FIG. 4 illustrates the occurrence and effects of toner scattering, and, image areas alternate with background areas at identical or similar intervals in an inclined direction in (b), which is an enlarged view of a part of an image shown in (a). As can be clear from (a) and (b) in FIG. 4, toner adheres to a relatively large area in the image shown in FIG. 4, and image area ratio is relatively high. Accordingly, a relatively large amount of toner scatters in the background as shown in (b) of FIG. 4. As shown in (c) of FIG. 4, which is an enlarged view of a part of (b), toner scattering in the background degrades the brightness of the periphery thereof due to optical dot gain. Accordingly, the periphery of toner scattering on the background becomes darker. Decreases in the brightness of the background due to dot gain are further described later with reference to FIG. 5.

Since toner scattering in the background is not the toner given to the electrostatic latent image, distribution of adhering toner is unstable. Accordingly, the brightness of the background becomes unstable, degrading color stability. That is, toner scattering changes the brightness of the background, making it to fluctuate, and degrades the stability of image brightness, thus degrading color stability.

In particular, in images whose image area ratio is high similarly to the image shown in FIG. 4, when parallel lines are used to create an image, distances between the parallel lines are reduced, thus increasing the amount of scattering toner. Therefore, scattering toner can affect the brightness of the background badly and adversely effects color stability accordingly.

From the above-described reasons, in electrophotographic image formation, typically color stability is lower than that in offset printing, and it is preferred to enhance color stability. However, changing image forming conditions in response to the degree of occurrence of toner scattering may degrade color stability on the contrary.

In view of the foregoing, in the image forming apparatus 100 according to the present embodiment, to address image quality degradation due to toner scattering, black images are developed by the development devices 80G and 80BK using black toners different in shade (color strength), and the controller 99 serving as the image processor to execute the following image processing for generating halftone patterns for representing images according to input image data (image processing method).

As described above, the amount of pigment in toners used in the development devices 80BK and 80G is adjusted such that the toner in the development device 80BK develops heavier color than that developed by the toner in the development device 80G. Therefore, hereinafter the toners used in the development devices 80G and 80BK are referred to as "gray toner (or light color toner)" and "black toner (or darker color toner or standard color toner)", respectively.

Figure 5A:
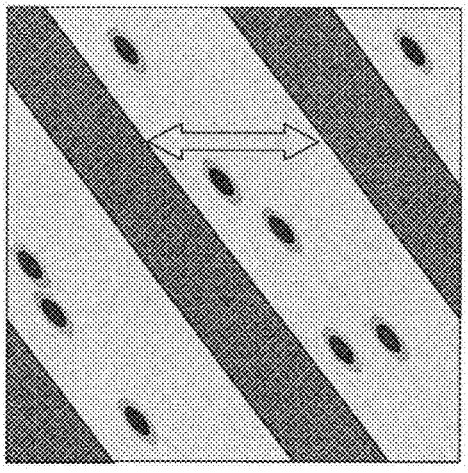
FIGS. 5A and 5B illustrate alleviation of adverse effects caused by toner scattering using multiple toners identical in color and different in shade.

Roughly speaking, in the image processing for forming halftone patterns according to the present embodiment, the controller 99 generates a light shade pattern and a darker shade pattern such that the light shade pattern and the darker shade pattern are shifted from each other when the light color toner image and the darker color toner image are superimposed one on top of the other as shown in FIG. 5A. Thus, the image processing according to the present embodiment includes a pattern generation for multiple toners (light color toner and darker color toner) identical in color and different in shade or color strength.

As shown in FIG. 5A, the controller 99 forms the halftone patterns using line screen. In electrophotographic image forming apparatuses, line screen is often used to form halftone toner patterns owing to its high image stability, and smooth gradation is available. In the image forming apparatus 100, line screen is also used for halftone patterns of other colors than black for achieving good image stability.

In FIG. 5A, solid black areas represent areas developed by black or darker color toner (hereinafter "darker toner adhesion areas" or simply "darker color areas"), and gray areas represent areas developed by gray or light color toner (hereinafter "light color toner adhesion areas" or simply "light color areas"). Additionally, black dots in the light color toner adhesion areas represent scattering toner, and gray rings around the black dots represents areas where the brightness of the background is lowered due to optical dot gain.

Figure 5B:
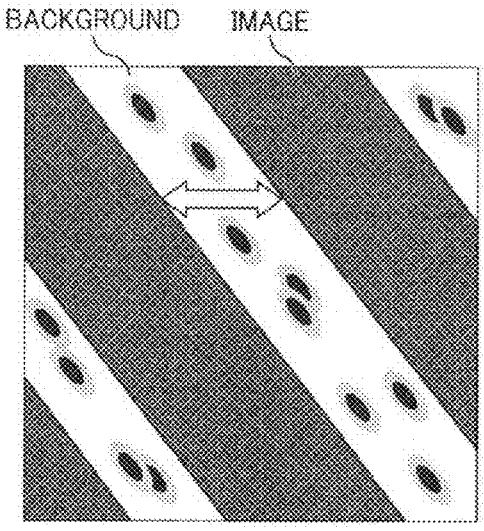

FIG. 5B illustrates an image developed by only darker color toner without using light color toner, and areas between black slant areas in FIG. 5B represent the background. In comparison between FIGS. 5A and 5B, it can be clear that the gray rings where the brightness of the background is lowered is less noticeable in the image shown in FIG. 5A, in which light color toner is used, than in the image shown in FIG. 5B.

In other words, with the masking using light color toner (i.e., gray toner), the background can have a brightness level similar to the lowered brightness of the gray rings as shown in FIG. 5A. This image processing can significantly alleviate degradation of color stability resulting from decreases in the brightness of the background due to optical dot gain caused by toner scattering.

Therefore, the amount of pigment is adjusted so that the lightness of the light color toner areas is similar to the lightness around scattering darker color toner although, in FIG. 5A, the lightness levels of these areas slightly different for ease of understanding.

When the image shown in FIG. 5A is compared with the image shown in FIG. 5B, the width of the black slant area is narrower and the darker toner adhesion area smaller in FIG. 5A than those of the image shown in FIG. 5B. As can be known from the difference in the width of arrows shown in FIGS. 5A and 5B, the light color toner adhesion area in FIG. 5A is wider than the slant background area in FIG. 5B.

That is, even if the darker toner adhesion area is reduced, with application of light color toner to the background, the color as a whole can be similar to the color represented by only darker color toner (i.e., standard color toner). As a result, the consumption of standard color toner can be reduced. Simultaneously, scattering of standard color toner in the light color toner area can be reduced since the area of standard color toner is reduced. Thus, adverse effects of toner scattering can be reduced synergistically.

Thus, adverse effects of toner scattering on color stability can be alleviated by using multiple toners identical in color and different in shade in combination. The possibility of occurrence of toner scattering is particularly high, affecting color stability significantly, in formation of images having a high image area ratio and a low lightness level. Therefore, use of multiple toners identical in color and different in shade in combination is advantageous in such image formation because the adverse effects on color stability can be reduced, enhancing color stability. It is to be noted that the number of identical color toners different in shade used in combination is not limited to two and can be three or greater.

Figure 12:
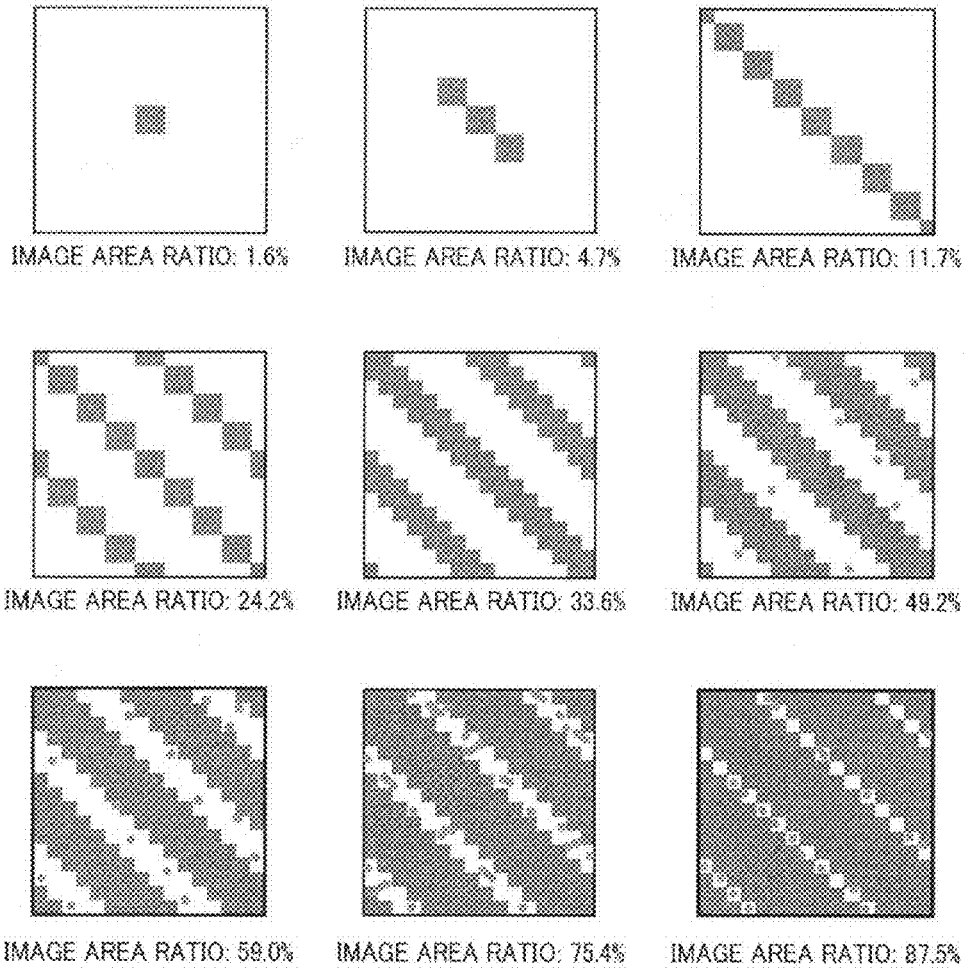
FIG. 12 is a schematic view illustrating occurrence of toner scattering in typical dot growth method.

FIG. 12 illustrates, as a comparative example, a method of generating halftone patterns using line screen. The comparative example shown in FIG. 12 involves a dot growth method in which image area ratio is increased by increasing the number of dots. The dot areas in FIG. 12 correspond to the areas developed by the darker color toner (standard black toner in the present embodiment). In the comparative example shown in FIG. 12, in images having a high image ratio and a low lightness level, the possibility of occurrence of toner scattering can be high, degrading color stability.

Similarly, the image processing executed by the controller 99 in the present embodiment involves dot growth in which image area ratio is increased in accordance with the density of images to be output.

Figure 6:
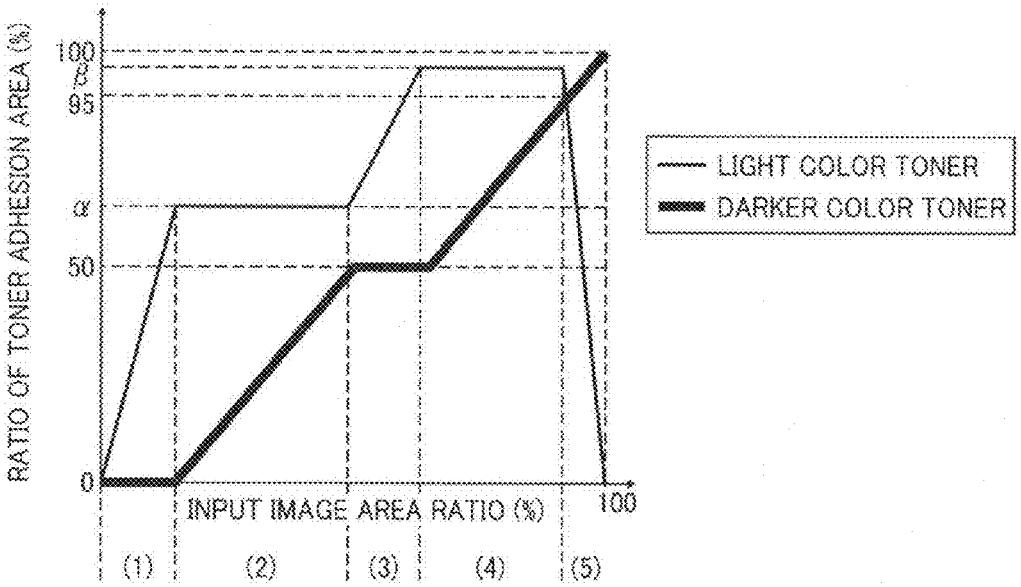
FIG. 6 is a graph illustrating a correlation between image area ratio according to input image data and ratio of toner adhesive area.

However, in the dot growth method used in the present embodiment, as shown in FIG. 6, each of patterns to be developed by the multiple identical colors different in shade is generated by independently increasing the image area ratio in accordance with the density of output images. That is, not only the darker shade pattern but also the light shade pattern is formed by independently increasing the image area ratio in accordance with the density of output images. As the order of formation of the patterns developed by the identical color toners different in shade, the patterns are formed from the lighter color to the darker color. With this method, the advantage resulting from reduction in the image area ratio of the standard color toner can be attained. It is to be noted that, when the number of toners identical in color and different in shade is three or greater, the patterns can be formed in the order from the lightest color to the darkest color similarly.

Figure 7:
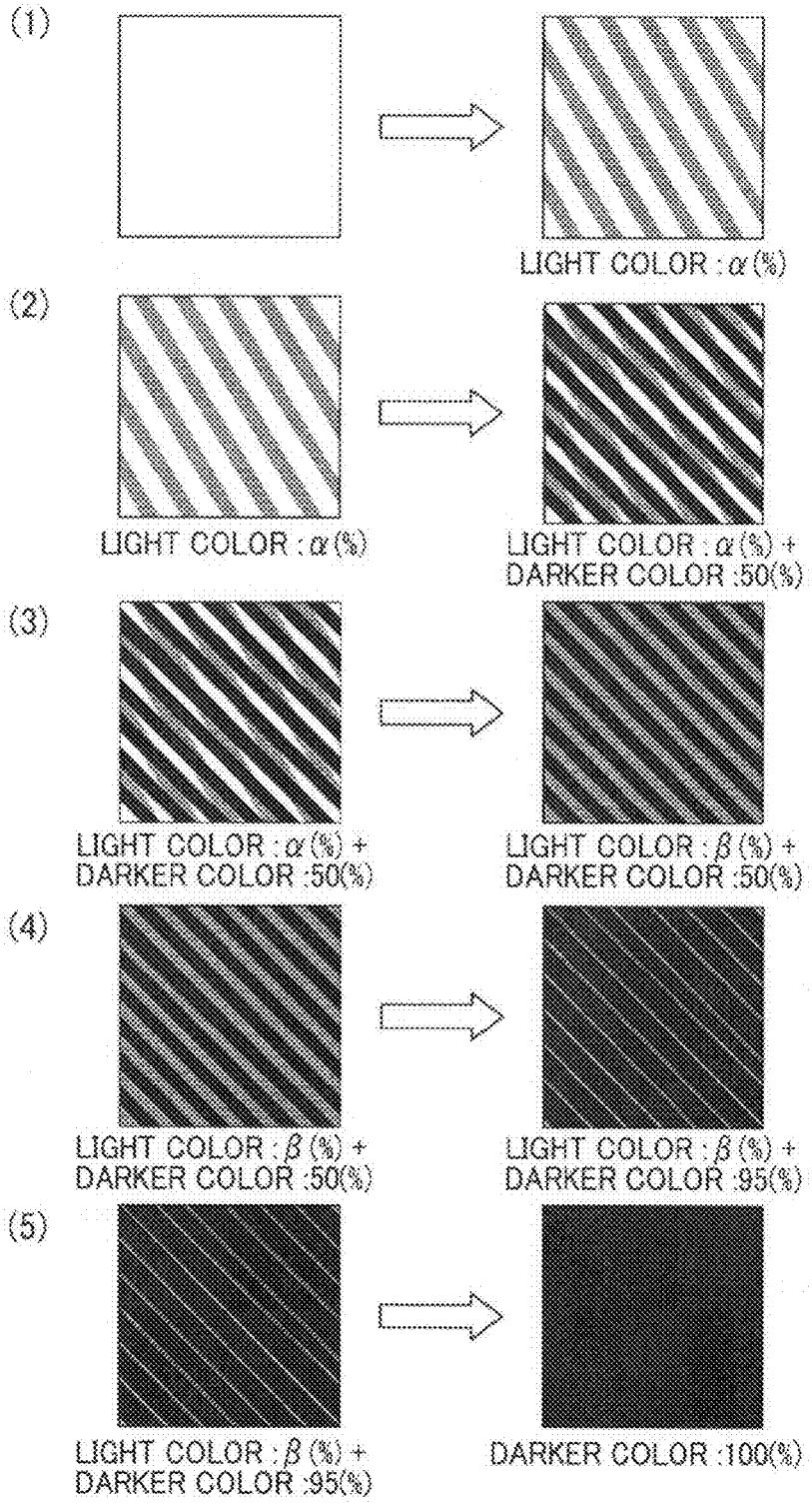
FIG. 7 schematically illustrates stages of forming patterns for multiple toners identical in color and different in shade.

Additionally, in the dot growth method according to the present embodiment, as shown in FIG. 7, the patterns for multiple identical color toners different in shade are shifted from each other. More specifically, each pattern is formed of parallel lines inclined in an identical direction, and the directions of inclined lines are different among the respective patterns for different shade toners. Thus, these patterns are shifted from each other and superimposed one on top of another. Since the inclination directions thereof are different, the multiple patterns of toners different in shade are not completely overlap with each other. Thus, light color toner (light shade color) can mask the gray rings (shown in FIG. 5B) where the brightness of the background is lowered.

Figure 8:
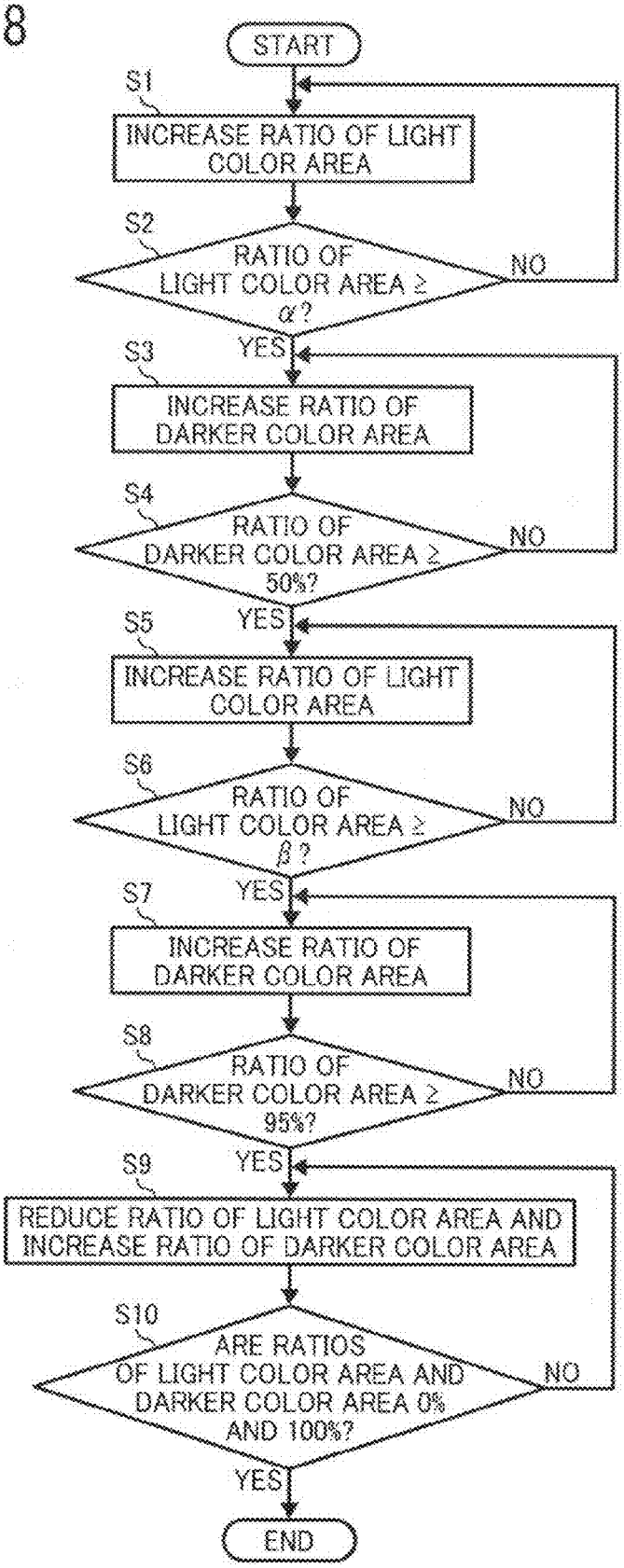
FIG. 8 is a flowchart of an image processing method according to an embodiment.

Descriptions are given below of the above-described dot growth method and the image processing method involving it with reference to FIGS. 6 through 8. It is to be noted that image density, that is, image area ratio, is not uniform in images formed through typical image formation, and accordingly the growth of respective color patterns employing dot growth at a given position must be stopped when the image area ratio at that position reaches the target value. However, FIGS. 6 through 8 do not indicate the growth stop of the pattern, which should occur when the image area ratio reaches a target ratio. In FIGS. 6 through 8, the growth stop is omitted for simplicity because such growth stop can occur at any timing while the image area ratio increases from 0% to 100%. Although these drawings may suggest that dot growth continues until the image area ratio reaches 100%, it is not true in practice unless the entire image is solid.

In the image processing method shown in these drawings, dot growth is divided into three stages. Specifically, in a first stage, an image pattern (light shade pattern or first shade pattern) having a higher lightness level is formed as shown in (1) and (2) of FIGS. 6 and 7 and steps S1 through S4 of FIG. 8. In a second stage, an image pattern (darker shade pattern or second shade pattern) having a lower lightness level is formed as shown in (3) and (4) of FIGS. 6 and 7 and steps S5 through S8. In a third stage, a solid image pattern is formed as shown in (5) of FIGS. 6 and 7 and steps S9 and S10 of FIG. 8.

The higher lightness image pattern formed in the first stage has an image area ratio up to 50%, the lower lightness image pattern formed in the second stage has an image area ratio greater than 50% and less than 95%, the solid image pattern formed in the third stage has an image area ratio greater than 95 up to 100%. It is to be noted that the manner of dividing dot growth is not limited to the description above. For example, dot growth may be divided into three stages similarly, but image area ratio ranges can be different depending on machine specification, sheet type, or properties of toner. Yet alternatively, the number of stages can be different. Similarly, $\alpha$ and $\beta$ can be different from those shown in FIGS. 7 and 8.

As shown in (1) of FIGS. 6 and 7 and steps S1 and S2, growth of dots constituting the light shade pattern is continued until the image area ratio, that is, the ratio of light color toner adhesion areas (also simply "light color area"), reaches $\alpha$%. In the method shown in FIGS. 6, 7, and 8, $\alpha$=60. Then, as shown in (2) of FIGS. 6 and 7 and steps S3 and S4, growth of dots constituting the darker shade pattern is continued until the image area ratio, that is, the ratio of darker toner adhesion areas (also simply "darker color area"), reaches 50%. However, at positions having an image area ratio lower than 50%, dot growth is stopped when the image area ratio reaches the target ratio as described above.

Then, as shown in (3) of FIGS. 6 and 7 and steps S5 and S6, growth of dots constituting the light shade pattern is continued until the image area ratio, that is, the ratio of areas developed by light color toner, reaches $\beta$%. In the method shown in FIGS. 6, 7, and 8, $\beta$=98. Then, as shown in (4) of FIGS. 6 and 7 and steps S7 and S8, growth of dots constituting the darker shade pattern is continued until the image area ratio, that is, the ratio of areas developed by darker toner, reaches 95%. However, at positions having an image area ratio lower than 95%, dot growth is stopped when the image area ratio reaches the target ratio.

Then, as shown in (5) of FIGS. 6 and 7 and steps S9 and S10, dots constituting the light shade pattern are reduced until the image area ratio, that is, the ratio of areas developed by the light color toner, reaches 0%, and simultaneously, dots constituting the darker shade pattern are increased until the image area ratio reaches 100%. However, at positions having an image area ratio lower than 100%, dot growth is stopped when the image area ratio reaches the target ratio.

When the image area ratio is greater than 95%, the image is almost solid, and the background subject to masking with light color toner loses the lightness to the degree that it is not affected by optical dot gain caused by toner scattering. That is, an aim of the light color toner for alleviating the adverse effects of optical dot gain is rendered meaningless. Therefore, the ratio of light color toner adhesion area is thus reduced to reduce consumption of light color toner.

As described above, the controller 99 generates the light shade pattern and the darker shade pattern to be superimposed with each other for generating the halftone pattern that can render the input image data. Since the inclination directions are different, the line screen pattern constituting the light shade pattern and the line screen pattern constituting the darker shade pattern are shifted from each other. Simultaneously, these line screen patterns can overlap with each other.

Additionally, consumption of light color toner may be reduced by a step of selecting superimposed areas after the step of generating the superimposed patterns. In this step, the darker shade pattern for the toner having the higher concentration is selected in areas where the darker shade pattern overlaps with the light shade pattern. That is, the light shade pattern is deleted from the areas where the two patterns overlap. Then, the controller 99 can reconstitute these patterns as patterns not to be superimposed. The step of superimposed pattern generation and the superimposed patterns generated therein can be deemed a first step and first images, respectively. The step of selecting superimposed areas and the patterns not to be superimposed can be deemed a second step and second images, respectively.

As described above, in the image processing method according to the present embodiment, halftone patterns are generated so that light color toner having a lightness level similar to that of backgrounds darkened by optical dot gain (for example, areas around standard color toner scattering in the background), is applied to the background areas. That is, the areas other than areas developed by darker color toner are covered with light color toner, thereby reducing the areas of the background where no toner is applied. This method can reduce adverse effects by the optical dot gain resulting from toner scattering. Since fluctuations in color caused by toner scattering can be reduced, color stability of halftone images can be enhanced.

When such halftone patterns are generated in formation of images having a high image area ratio (i.e., low lightness images), which are susceptible to adverse effects of toner scattering in the background, it can significantly improve color stability in such low lightness areas. Since the darker color toner adhesion areas decreases as the image density of the background increases, the amount of scattering toner itself can decrease. Moreover, consumption of darker color toner can be reduced as the darker color toner adhesion area decreases.

Using commercial apparatuses, a test was performed to examine improvement of color stability by the image processing method shown in FIGS. 6, 7, and 8.

It is to be noted that, when only a single image forming apparatus is used to examine such improvement in yellow, magenta, cyan, and black, typically used for forming full-color images, eight image forming stations are necessary to form each of toner images using light color toner and darker color toner. The test, however, was executed using an apparatus including four image forming stations, and combination of colors was changed depending on the color tested. Specifically, instead of adding another image forming station for light shade color of the color tested, one of other color stations is omitted and replaced with the light color station.

A test was executed under the following conditions: Images having an output image area ratio of 70% were formed using SPR-CE toner by an image forming apparatus, imagio-mp-C3300, on 20 sheets (N=20) of 70 W paper for each color, and color difference was measured at nine positions shown in FIG. 9. The amount of pigment in light color toner was adjusted to 40% of that of standard color toner, that is, darker color toner. The input image area ratios, $\alpha$ and $\beta$, of light color were 50% and 90%, respectively.

Figure 9:
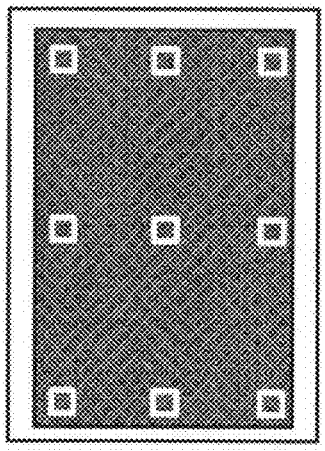
FIG. 9 is a schematic diagram illustrating an image used in an experiment to check reduction in adverse effects caused by toner scattering.

In the test of each of yellow, magenta, cyan, and black, images having an identical image area ratio of 70% as a whole were output, and color stability was checked at nine positions indicated by small rectangles shown in FIG. 9.

(Evaluation Method)

In the evaluation, mean color difference $\Delta E$ inside a page was calculated to indicate differences in color, and a mean value of values measured at the nine positions was used as a reference.

(Evaluation Results)

Figure 10:
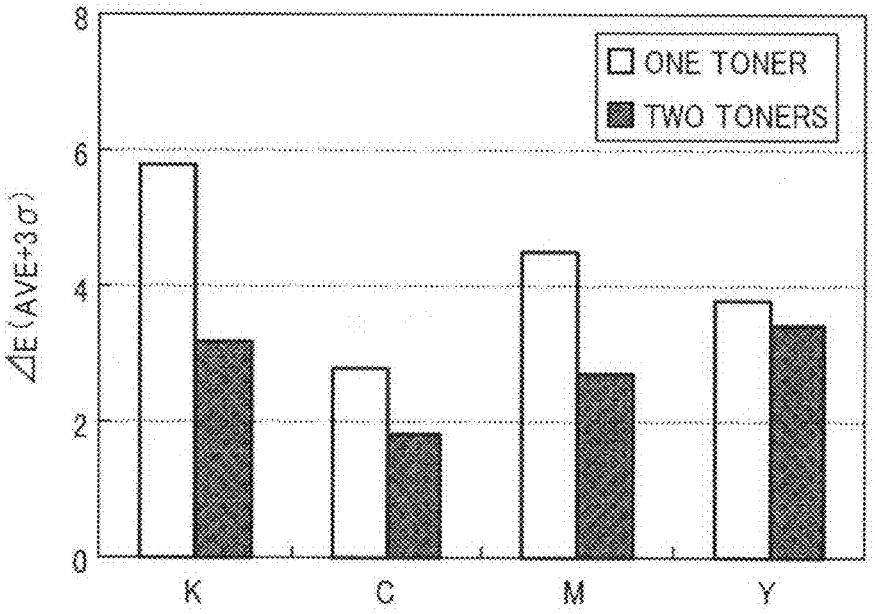
FIG. 10 is a graph of results of the experiment to check reduction in adverse effects caused by toner scattering.

The graph shown in FIG. 10 compares the mean color differences $\Delta E$ plus $3\sigma$ inside a page of output images in both of cases in which two toners (standard color toner and light color toner) were used and only standard color toner was used for each of yellow, magenta, cyan, and black. As the mean value $\Delta E+3\sigma$ increases, color stability decreases.

As shown in FIG. 10, in all of yellow, magenta, cyan, and black, the color difference in the case in which two toners were used was smaller than that in the case in which only standard color toner was used although the difference was small in the case of yellow. Thus, it was confirmed that use of light color toner in addition to standard color toner improved color stability. It can be assumed that improvement in yellow is not significant because the contacts between yellow and background is smaller compared with other colors.

Thus, as the contrast increases, the color stability can be improved more by using multiple toners identical in color and different in shade. Therefore, when the number of image forming stations is limited in image forming apparatuses that form full-color images, it is preferred that color having higher contrast be given priority for providing the light color station although it is preferable to use multiple toners identical in color and different in shade for each color for better color stability. In view of the foregoing, in the image forming apparatus 100 according to the present embodiment, light color toner is used in combination with standard color toner for forming black images, the contrast of which is typically high, thus restricting the number of image forming stations 60.

Additionally, when the number of image forming stations is limited, it is preferred that color susceptible to adverse effects on color stability by toner scattering be given priority for providing the light color station. It is to be noted that color susceptible to adverse effects on color stability by toner scattering depends on properties of toner.

Accordingly, in an image forming apparatus employing the image processing method according to the present embodiment, the number of image forming stations can be at least the number of original colors (such as yellow, cyan, magenta, and black) plus one. For example, in monochrome (single color) image forming apparatuses, the number of image forming stations is two.

The controller 99 can execute an image processing program stored in the ROM to execute the above-described image processing method including generation of halftone patterns by generating patterns for multiple toners identical in color and different in shade, shifted from each other, for rendering images according to input image data. In this regard, the controller 99 or the ROM incorporated therein can serve as a memory storage storing the image processing program. Alternatively, the image processing program may be stored in any other recording media than the ROM. Examples of recording media include a semiconductor recording medium such as RAM, and a nonvolatile memory; optical recording medium such as a digital versatile disc (DVD), a magnetooptic disc (MO), a magnetic disk (MD), and a compact disc-recordable (CD-R); and a magnetic recording medium such as a hard disc, a magnetic tape, and a flexible disc. Such recording media can serve as a computer-readable memory medium storing the image processing program.

The present invention is not limited to the details of the example embodiments described above, and various modifications and improvements are possible.

Figure 11:
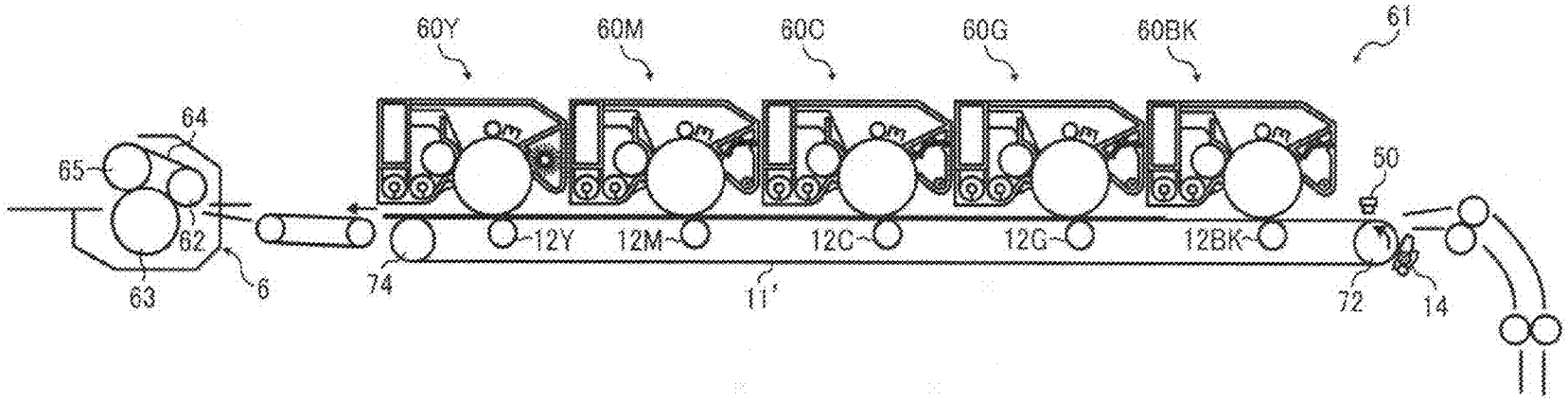
FIG. 11 is a front view of an image forming apparatus according to another embodiment.

For example, the above-described features of the embodiment can adapt to tandem image forming apparatuses employing direct transfer methods as shown in FIG. 11. FIG. 11 illustrates a part of a tandem image forming apparatus of direct transfer type. Components of the image forming apparatus shown in FIG. 11 similar to those of the image forming apparatus 100 shown in FIGS. 1 and 2 are given identical reference numerals. The image forming apparatus shown in FIG. 11 includes, instead of the intermediate transfer belt 11, a conveyance belt 11' that transports sheets of recording media. Respective color toners are directly transferred from the image forming stations 60 and superimposed one on top of another on the sheet being transported by the conveyance belt 11'.

Direct transfer methods tend to impose a limitation on component layout such that a sheet feeder and the fixing device 6 must be disposed on sides of the image forming stations 60 in a direction in which the sheet is transported by the conveyance belt 11', thus increasing the lateral size of the apparatus. By contrast, indirect transfer methods are advantageous in that the secondary-transfer position can be disposed relatively flexibly, and the sheet feeder and the fixing device 6 can overlap with the image forming stations 60 in the lateral direction, reducing the lateral size of the apparatus. Further, to reduce the size of the direct transfer image forming apparatus in the sheet conveyance direction, the fixing device 6 is disposed adjacent to the conveyance belt 11'. In this arrangement, however, it is difficult to secure a sufficient distance between the fixing device 6 and the conveyance belt 11' for the sheet to deform. Accordingly, it is possible that image formation on the upstream side is affected by impact of the sheet entering the fixing device 6, which is greater when the sheet is thick, or differences between the velocity at which the sheet passes through the fixing device 6 and the sheet conveyance velocity of the conveyance belt 11'. By contrast, in indirect transfer image forming apparatuses, the distance between the fixing device 6 and the conveyance belt 11' can be sufficient for the sheet to deform, and the fixing device 6 can be prevented from effecting image formation. In these regards, for tandem image forming apparatuses, indirect transfer methods are preferred at present.

Additionally, the above-described features of this specification can adapt to single-drum type image forming apparatuses involving so-called revolver development or rotary development, in which different color toner images are formed on an identical photoreceptor drum. When the respective color toners are formed at different positions on the photoreceptor drum, a member similar to the intermediate transfer belt 11 is used. When the respective color toners are superimposed one on another on the photoreceptor drum, a member similar to the conveyance belt 11' is used.

Single-drum type image forming apparatuses can be compact because only a single photoreceptor drum is used, and the cost can be lower. In single-drum type image forming apparatuses, however, high-speed image formation is difficult because image formation is repeated (five times when yellow, magenta, cyan, gray, and black toners are used) on the identical photoreceptor drum. By contrast, increasing the image formation speed can be easier in tandem image forming apparatuses although the apparatus may become bulkier, increasing the cost. At present, tandem image forming apparatuses are preferred to form multicolor images as fast as the speed of monochrome image formation.

Further, the image forming apparatus 100 is a multifunction printer capable of multicolor and monochrome image formation. Alternatively, the image forming apparatus 100 may be a monochrome image forming apparatus.

The developer used in the image forming apparatus 100 can be either one-component developer or two-component developer as long as it is suitable for the above-described image processing method.

The image forming apparatus according to the above-described embodiment may be any of a copier, a printer, a facsimile machine, and a multifunction machine.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image processing method for generating a halftone pattern for forming an image according to input image data, the image processing method comprising:

a step of forming, by processing circuitry, a first shade pattern to be developed by a first toner; and a step of forming, by the processing circuitry, a second shade pattern to be developed by a second toner, wherein the second toner is identical in color to the first toner and different in shade from the first toner, and the second shade pattern is shifted from the first shade pattern.

2. The image processing method according to claim 1, further comprising:

a step of forming a superimposed pattern in which the first shade pattern and the second shade pattern overlap with each other.

3. The image processing method according to claim 2, wherein the step of forming the first shade pattern and the step of forming the second shade pattern are performed in an order from a lighter shade to a darker shade.

4. The image processing method according to claim 1, wherein the halftone pattern is constituted of line screen.

5. The image processing method according to claim 1, wherein the shade of the first toner is lighter than the shade of the second toner, and a lightness level of the first toner is similar to a lightness level of an area around the second toner scattering in a background area.

6. The image processing method according to claim 1, wherein each of the first and second shade patterns is generated by independently increasing an image area ratio to correspond to a density of the image according to the input image data.

7. An image processor for generating the halftone pattern using the method according to claim 1.

8. The image processing method according to claim 1, wherein the second shade pattern is shifted from the first shade pattern by rotating the second shade pattern with respect to the first shade pattern such that the second shade pattern has an angular orientation that is different from an angular orientation of the first shade pattern.

9. An image forming apparatus comprising:

an image forming device that forms a toner image according to input image data using first and second toners identical in color and different in shade from each toner; and image processing circuitry configured to generate a halftone pattern for forming the toner image according to the input image data, wherein the image processing circuitry forms first and second shade patterns to be developed by the first and second toners, respectively, and the second shade pattern is shifted from the first shade pattern.

10. The image forming apparatus according to claim 9, wherein the image forming device comprises:

a first development device to develop with the first toner an electrostatic latent image according to the first shade pattern; and a second development device to develop with the second toner an electrostatic latent image according to the second shade pattern.

11. The image forming apparatus according to claim 10, wherein, in the first and second toners used in the first and second development devices, respectively, an amount of pigment is adjusted to make a lightness level of the first toner similar to a lightness level of an area around the second toner scattering in a background area of the image formed according to the input image data.

12. The image forming apparatus according to claim 9, wherein the second shade pattern is shifted from the first shade pattern by rotating the second shade pattern with respect to the first shade pattern such that the second shade pattern has an angular orientation that is different from an angular orientation of the first shade pattern.

* * * * *